US008751208B2

(12) United States Patent
Brouwer et al.

(10) Patent No.: US 8,751,208 B2
(45) Date of Patent: Jun. 10, 2014

(54) METHOD FOR PRODUCING HYDROCARBONS THROUGH A WELL OR WELL CLUSTER OF WHICH THE TRAJECTORY IS OPTIMIZED BY A TRAJECTORY OPTIMISATION ALGORITHM

(75) Inventors: Dirk Roelof Brouwer, Rijswijk (NL); Johan Dirk Jansen, Rijswijk (NL); Gerardus Jozef Peter Joosten, Rijswijk (NL); Stijn Vlemmix, Waddinxveen (NL)

(73) Assignee: Shell Oil Company, Houston, TX (US)

( * ) Notice: Subject to any disclaimer, the term of this patent is extended or adjusted under 35 U.S.C. 154(b) by 982 days.

(21) Appl. No.: 12/808,503

(22) PCT Filed: Dec. 18, 2008

(86) PCT No.: PCT/EP2008/067915

§ 371 (c)(1),
(2), (4) Date: Oct. 15, 2010

(87) PCT Pub. No.: WO2009/080711

PCT Pub. Date: Jul. 2, 2009

(65) Prior Publication Data

US 2011/0024126 A1 Feb. 3, 2011

(30) Foreign Application Priority Data

Dec. 20, 2007 (EP) ..... 07123862
Feb. 6, 2008 (EP) ..... 08101334

(51) Int. Cl.
*G06G 7/48* (2006.01)

(52) U.S. Cl.
USPC ..... 703/10

(58) Field of Classification Search
USPC ..... 703/10
See application file for complete search history.

(56) References Cited

U.S. PATENT DOCUMENTS 6,549,879 B1 * 4/2003 Cullick et al. ..... 703/10
8,005,658 B2 * 8/2011 Tilke et al. ..... 703/10
2009/0056935 A1 * 3/2009 Prange et al. ..... 166/245

OTHER PUBLICATIONS

M. Handels et al., "Adjoint-Based Well-Placement Optimization Under Production Constraints," Feb. 26, 2007, Society of Petroleum Engineers, SPE 105797, pp. 1-7.*

P.V.R. Suryanarayana et al., "Mathematical technique improves directional well-path planning," 1998, Oil & Gas Journal, vol. 96, No. 34, pp. 1-7.*

(Continued)

*Primary Examiner* — Kamini Shah
*Assistant Examiner* — Russ Guill

(57) ABSTRACT

A method for producing hydrocarbon fluid, such as crude oil and/or natural gas, through a well or well cluster of which the trajectory is at least partly defined and iteratively optimized by an well trajectory optimization algorithm that is coupled to a finite difference reservoir simulation program that represents a hydrocarbon fluid containing reservoir as a set of grid cells with a specified permeability and fluid content, wherein the algorithm:

provides a virtual well with a series of virtual well branches that extend into cells in the vicinity of inflow points of the virtual well; and subsequently iteratively moves the inflow points of the virtual well or well cluster through the reservoir in order to optimize a reservoir depletion strategy that provides an optimized life cycle value of the well and/or well cluster and/or optimized Net Present Value (NPV) of the produced crude oil and/or natural gas.

7 Claims, 9 Drawing Sheets

(56) References Cited

OTHER PUBLICATIONS

E.M. Shokir et al., "A new optimization model for 3-D well design," 2004, Emirates Journal for Engineering Research, vol. 9, No. 1, pp. 67-74.*

A. Larionov et al., "Methodology of optimal well pattern, location and paths in productive formations during oil and gas fields development planning," 2006, Society of Petroleum Engineers, SPE 104326, pp. 1-10.*

Burak Yeten et al., "Optimization of nonconventional well type, location and trajectory," 2002, Society of Petroleum Engineers, SPE 77565, pp. 1-14.*

A. Khaled et al., "3-D Well Design Using Computer Optimization Model," 1999, Society of Petroleum Engineers, pp. 1-14.*

An Li et al., "Optimization model and algorithm of the trajectory of horizontal well with perturbation," 2006, Journal of Applied Mathematics & Computing, vol. 20, No. 1-2, pp. 391-399.*

SPE paper 69439 "The Use of Genetic Algorithms in Well Placement Optimization" presented by Montes et al. at the 2001 SPE Latin American and Caribbean Petroleum Engineering Conference, Buenos Aires, Argentina, Mar. 25-28.

"On Optimization Algorithms for the Reservoir Oil Well Placement Problems", presented by Bangerth et al. at the Institute for Computational Engineering and Sciences, University of Texas, Austin, Aug. 17, 2006.

"Closed-loop Reservoir Management" presented by J.D. Jansen et al. First Break, (Jan. 2005) 23.

* cited by examiner

Fig.1
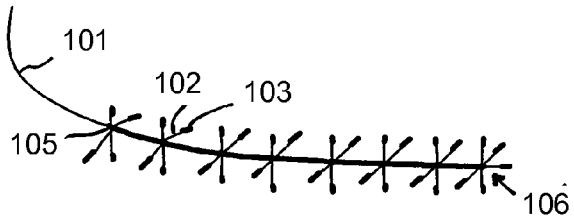
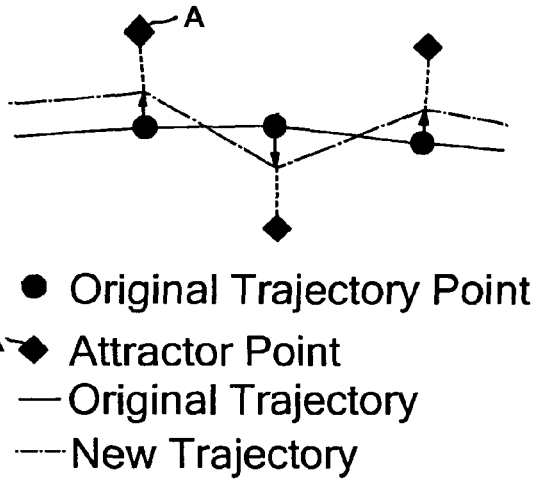
Fig.2
Fig.3
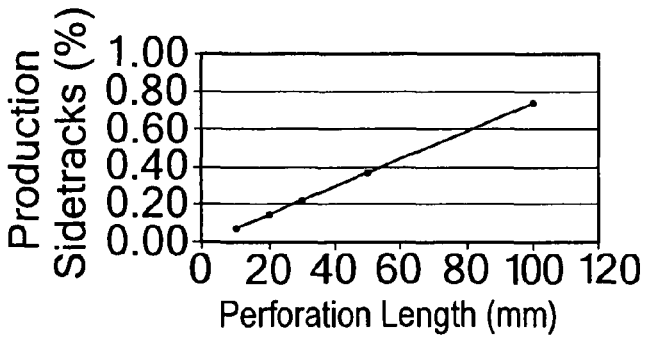

Fig.10
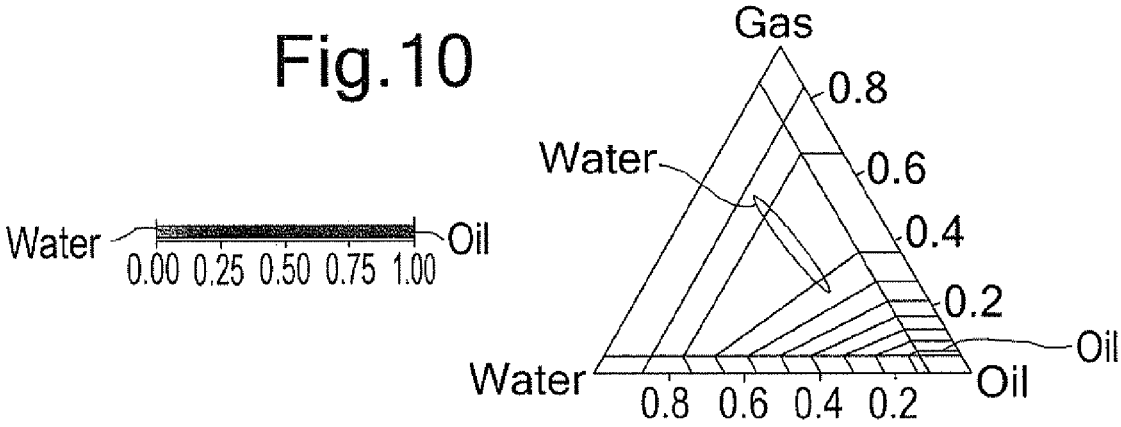
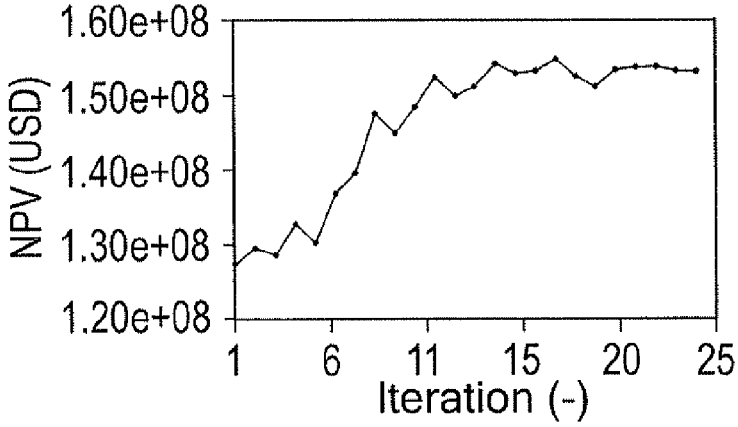
Fig.11
Fig.12
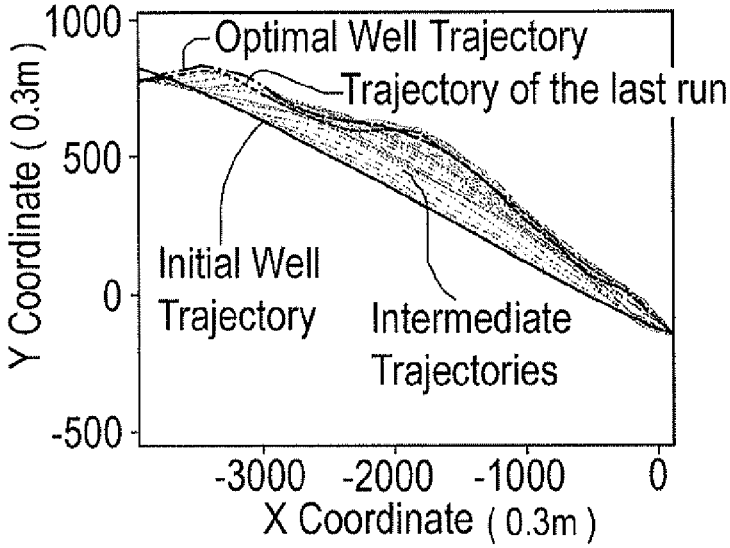

METHOD FOR PRODUCING HYDROCARBONS THROUGH A WELL OR WELL CLUSTER OF WHICH THE TRAJECTORY IS OPTIMIZED BY A TRAJECTORY OPTIMISATION ALGORITHM

PRIORITY CLAIM

The present application claims priority to PCT Application EP2008/067915, filed 18 Dec. 2008, which claims priority to European Patent Application No. EP 07123862.0, filed 20 Dec. 2007 and to European Patent Application No. EP 08101334.4, filed 6 Feb. 2008.

BACKGROUND OF THE INVENTION

The invention relates to a method for producing hydrocarbon fluid through a well or well cluster of which the trajectory is at least partly defined by a well trajectory optimization algorithm which is coupled to a finite difference reservoir simulation program that represents a hydrocarbon fluid containing reservoir as a set of grid cells with a specified permeability and fluid content.

Such a method is known from SPE paper 105797 "Adjoint Based Well Placement Optimization Under Production Constraints", paper SPE 105797 presented by M Handels, M J Zandvliet, D R Brouwer and J D Jansen at the 2007 SPE Reservoir Simulation Symposium, Houston 26-28 Feb. 2007.

The selection of the optimal well locations and trajectories is a challenging and important step in any field development plan.

Selecting the most optimal well trajectory is an arduous task, which is usually done manually.

SPE paper 105797 discloses an automated iterative well trajectory optimization technique wherein vertical pseudo wells are used which produce or inject at a very low rate, and thus have a negligible influence on the overall fluid flow through a hydrocarbon fluid containing reservoir.

A disadvantage of the automated well trajectory optimization technique according to SPE paper 105797 is that it is configured to optimize a well trajectory only for two-dimensional placement of a vertical well in a relative simple reservoir since the method involves moving a vertical virtual well iteratively in horizontal directions until an optimum production is achieved.

A further disadvantage of the automated iterative well trajectory optimization technique known from SPE paper 105797 is that it requires a large amount of iterative calculations to optimize the positioning of the vertical well trajectory of the virtual well and that it only allows to optimize production from a vertical well.

It is an object of the present invention to further optimize the automated well trajectory optimization process such that it also can be applied to curved and non-vertical wells and to reduce the amount of iterative calculations to optimize the trajectory of a well or well cluster.

SUMMARY OF THE INVENTION

In accordance with the invention there is provided a method for producing hydrocarbon fluid, such as crude oil and/or natural gas, through a well or well cluster of which the trajectory is at least partly defined by a well trajectory optimization algorithm which is coupled to a finite difference reservoir simulation program that represents a hydrocarbon fluid containing reservoir as a set of grid cells with a specified permeability and fluid content and which algorithm:

provides a virtual well with a series of virtual well branches that extend into cells in the vicinity of inflow points of the virtual well; and subsequently iteratively moves the inflow points of the virtual well or well cluster through the reservoir. It is preferred that the well trajectory optimization algorithm iteratively optimizes the trajectory of the virtual well such that a modified well trajectory is defined with a higher Net Present Value (NPV) than its predecessor in order to optimize a reservoir depletion strategy by the well and/or well cluster.

Preferably the method comprises the steps of:

a) defining an initial well trajectory of a virtual well with a series of fluid inflow points in the reservoir;

b) inducing the algorithm to provide the virtual well with a series of virtual well branches that extend into cells in the vicinity of the inflow points of the virtual well;

c) inducing the reservoir simulation program to assign relative impact of all principal virtual well branches on the reservoir depletion strategy;

d) inducing the algorithm to identify a series of target points to which a series inflow points of the virtual well should be moved in order to obtain an optimized reservoir depletion strategy which generates a higher life cycle value of the virtual well;

e) inducing the algorithm to modify the trajectory of the virtual well into an optimized and drillable well trajectory of an optimized virtual well of which a series of inflow points are migrated towards a series of target points;

f) repeating steps b), c), d) and e) a number of times thereby iteratively further optimizing the trajectory of the virtual well until a final virtual well trajectory is defined by the well trajectory optimization algorithm;

g) drilling and completing a well which has the final virtual well trajectory as a target; and f) producing hydrocarbon fluid through the well from the hydrocarbon fluid containing reservoir.

Further preferred embodiments of the method according to the invention are described in sub-claims 4-9.

The method according to the invention provides a new technique to determine the optimal well trajectory with the aid of a so called gradient-based search method, which is based on surrounding the well trajectory with sidetracks to adjacent grid cells or grid blocks in a reservoir simulation model. Optionally, these sidetracks have such a small perforation and thus production rate that they have a very small impact on the production through the main well bore.

Optionally the gradients of the Net Present Value (NPV) of the well over the total producing life of the reservoir, with respect to the productivity of the sidetracks, are computed using an adjoint model. Using the gradients of the sidetracks coordinates for "attractor points" or "target points" may be selected. With these attractor points a new optimized well trajectory may be constructed. The process may be repeated until a final trajectory with a maximum NPV is reached. The reservoir model used for the optimization process may be a three-dimensional heterogeneous finite difference reservoir model, which represents the reservoir as a set of grid cells with a specified permeability and fluid content and in which model the reservoir is traversed by one or more virtual wells, that traverse at least some of the grid cells or gridblocks of the reservoir model. The reservoir may be a thin oil rim in a plunging anticline cut off by a fault running through the top of the anticline. Results of computer calculations show significant improvement in the NPV or "Life Cycle Value" of the simulated well or well cluster, which is optimized in accordance with the method according to the invention. Depending on the value that is assigned to the produced fluids (oil/water/gas) in the cost function, the iterative well trajectory optimization method according to the invention will seek a well path for an oil well in the reservoir that is either away from the gas cap, or in case of a valuation favorable for the gas, towards the gas cap.

These and other features, advantages and embodiments of the method according to the invention are described in the accompanying claims, abstract and the following detailed description of preferred embodiments in which reference is made to the accompanying drawings.

BRIEF DESCRIPTION OF THE DRAWINGS

FIG. 1 shows a schematic view of a main wellbore with pseudo or virtual sidetracks to all adjacent grid cells;

FIG. 2 shows how attractor or target points are used to move the well trajectory in a certain direction;

FIG. 3 shows the percentage of flow through the sidetrack perforation versus the perforation length;

FIG. 10 shows a Relative Oil Permeability plot of the reservoir model shown in FIG. 8;

FIG. 11 shows the NPV of the well against the number of iterations;

FIG. 12 shows a top view of the moving well trajectory;

DETAILED DESCRIPTION OF THE EMBODIMENTS SHOWN IN THE DRAWINGS

Figure 4:
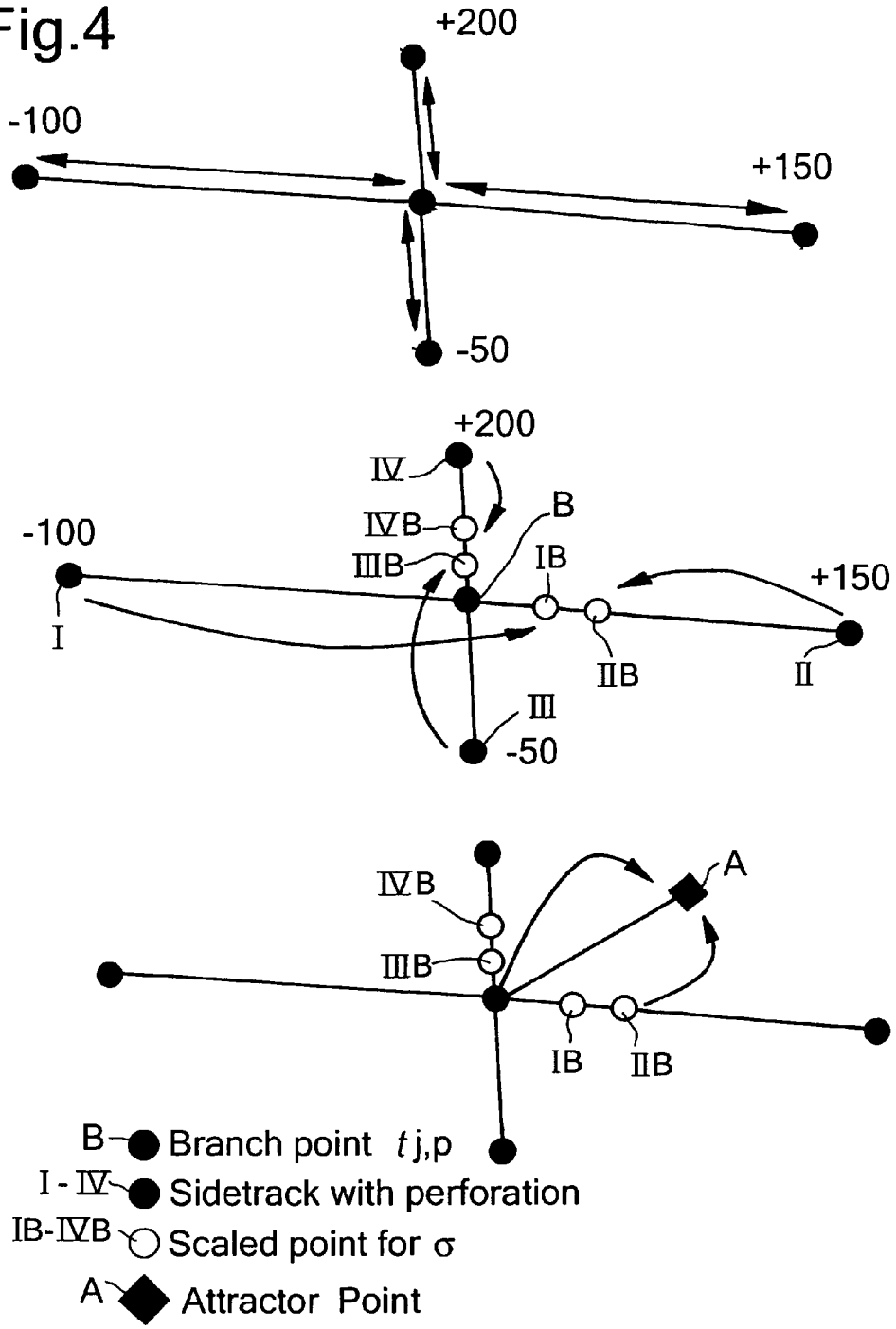
FIG. 4 is a schematic view of a gridblock with four sidetracks generated in accordance with the invention.

In the following detailed description of the depicted embodiments of the method according to the invention and in the accompanying claims the following terms have the following meanings:

A pseudo or virtual sidetrack is a model sidetrack with a very small perforation and small fluid influx from the reservoir.

A branch point is a trajectory point that functions as branch node for a pseudo or virtual sidetrack.

An attractor or target point of a well trajectory node is a calculated point that indicates the end of a target vector and/or three dimensional target direction in which the associated trajectory node of a virtual well should be moved to optimise a reservoir depletion strategy.

The nomenclature of the following abbreviations is used:

$\alpha$=weighting factor for the old trajectory
A=attractor point
$\beta$=weighting factor for the attractor points
$\gamma$=dogleg severity [deg/FT]
c=constant
d=discount factor, [−/s]
G=gradient value [USD]
J="objective function" or "life cycle value"[M][USD]
k=permeability, [mD]
$\kappa$=ICV setting [−]
l=along hole length of a sidetrack [m]
$\mu$=viscosity, [Pa s]
q=flowrate, [BBL/day]
r=price per unit volume, [USD/BBL]
R=Radius of the circular arc between two trajectory points [m]
r=vector
$\rho$=density, [kg/m$^3$]
S=saturation [−]
$\sigma$=absolute value of gradient divided by along hole length [USD/m]
T=simulation time, [day]
t=trajectory coordinate
$\tau$=smoothing factor
v=directional vector between two trajectory points
$\phi$=porosity [−]

The following nomenclature for subscripts will be used:

o=oil
w=water
g=gas
p=trajectory coordinate point counter
n=sidetrack per trajectory point counter
j=iteration counter
h=horizontal
v=vertical Deciding on a well trajectory with the aim of obtaining an optimal project net present value (NPV) or life cycle value of a well or well cluster is a task that is usually done manually. Many sensitivity runs in reservoir simulators combined with engineering experience are then needed to result in an optimal well or well cluster trajectory.

The purpose of the method according to the invention is to automate this process and to introduce and apply a gradient-based algorithm that steps with each iteration towards an optimal well trajectory, with a minimal number of iterations.

SPE paper 105797 [D1] describes an optimisation approach for well location, but only for 2-dimensional placement of a vertical well in a relative simple reservoir. In accordance with the invention the known method is extended to a three-dimensional model and to a full well trajectory and well pattern architecture instead of a surface location only. An example of an application of the method according to the invention is described in the detailed description of the embodiments shown in the drawings in a reservoir that comprises a thin oil rim. For a thin oil rim the optimal well trajectory is very important because water coning and gas gusping can occur early in the field life and limit the oil recovery.

The oil rim chosen for modelling has a large gas cap and aquifer compared with a relatively small oil rim of approximately 10 m (30 ft). The mid-rim placed well trajectory is therefore very sensitive to minor adjustments, lowering the trajectory immediately leads to more water production and less gas production.

Over the last years many different optimisation algorithms have been developed. The techniques for well placement and trajectory optimisation can be classified as either stochastic or deterministic.

An example of a stochastic algorithm applied in trajectory optimisation is the Genetic Algorithm (GA), which is describer in the following papers:

[D2] SPE paper 104326 "*Methodology of Optimal Well Pattern, Location and Paths in Productive Formations During Oil and Gas Fields Development planning*" presented by Larinov et al. at the 2006 SPE Russian Oil and Gas Technical Conference, Moscow, October 3-6.

[D3] a Phd Dissertation of B. Yeten: "*Optimum Deployment of Nonconventional Wells*", Stanford, June 2003.

[D3] SPE paper 86890 by B. Yeten et al "*Optimization of Nonconventional Well Type, Location, and Trajectory*", which was revised for publication from paper SPE 77565 presented at the 2002 SPE Annual Technical Conference and Exhibition, San Antonio, Tex., 29 Sep.-2 Oct. 2002.

[D4] SPE paper 69439 "*The Use of Genetic Algorithms in Well Placement Optimization*" presented by Montes et al. at the 2001 SPE Latin American and Caribbean Petroleum Engineering Conference, Buenos Aires, Argentina, March 25-28.

Good results with significant increase in NPV are achieved but they come at the costs of a very large number of runs in a reservoir simulator. Methods such as replacing the simulator with an artificial neural network, as described in [D3], [D4] and [D5], may be applied in the method according to the invention, but the required number of iteration runs is still very large. One advantage of stochastic methods is that the optimum found is in theory the global optimum; because, as described in [D3] if the simulator runs long enough, every state must occur.

The paper "*On Optimization Algorithms for the Reservoir Oil Well Placement Problems*", presented by Bangerth et al. at the Institute for Computational Engineering and Sciences, University of Texas, Austin, 17 Aug., 2006 [D7] describes Deterministic methods, Perturbation Stochastic Approximation (SPSA) and Finite Difference Gradient (FDG) which require few reservoir runs and increase NPV with every iteration. The SPSA can be seen as a stochastic version of the steepest descent method where a stochastic vector replaces the gradient vector. In the FDG approach the stochastic vector is replaced by a finite difference approximation. The gradient based approach described in [D1], in an article on pages 391-402 of the SPE journal of December 2004 Brouwer, D. R. and Jansen, J. D.: "*Dynamic optimisation of water flooding with smart wells using optimal control theory*", by D. R. Brouwer and J. D. Jansen [D8] and in SPE paper 92864 "*Implementation of adjoint solution for optimal control of smart wells*", presented by Sarma et al. at the 2005 SPE Reservoir Simulation Symposium, Houston, USA, January 31-February 2.

The gradient based approach described in [D1], [D8] and [D9] is preferably used in the method according to the invention. The gradient based approach is very efficient and requires a relatively few iterations. The optimum found is likely to be a local optimum however, and not the global solution.

In the gradient-based method according to the invention the gradients are calculated using an adjoint-model. The adjoint method, derived from optimal control theory is now receiving considerable attention in the field of closed loop reservoir management, as described in the paper "*Closed-loop Reservoir Management*" presented by J. D. Jansen et al. First Break, (January 2005) 23 [D10]. The principal advantage is that the adjoint method only requires one forward and one backward run to calculate the gradient of all the sidetracks, whereas with perturbation scheme a number of runs equal to the number of "sidetracks" would have to be used.

The difference with the use here is that in those applications the parameters to be optimized are often flow rates, bottom-hole pressures or a valve setting. In our, heuristic, approach the adjoint method is used to calculate the gradient of the NPV of the well, with respect to pseudo valves in sidetracks. These gradients are used to construct improved points, so called "attractor points" or "target points" or "target directions" on a new well trajectory.

In the following detailed description of a preferred embodiment the NPV described in the objective function J is optimized by changing the well trajectory. In this specification and accompanying claims the terms "objective function" J and "life cycle value" are used as equivalents.

An optimized trajectory is defined in this specification and the accompanying claims as a well path with a higher NPV than its predecessor. It will be understood that the terms "well path" and "well trajectory" are equivalent.

The objective function J or "life cycle value" is defined as the total oil revenue minus the total gas and water production costs over a time interval [0,T], in combination with a discount factor d. Letting $r_o$ denote oil revenue per unit volume, $r_w$ the water disposal cost per unit volume, and $r_g$ the gas revenue or disposal cost per unit volume we can write;

$$J(traj) = \int_0^T V \cdot \frac{1}{(1 + d(t))^t} dt$$

where $q_o$, $q_w$ and $q_g$ are the production rates for oil, water, and gas respectively. The vector traj is a composite vector, representing the complete well path.

The approach to the trajectory optimization is to allow each coordinate point of the well to "move" through the reservoir. We do this by creating pseudo-sidetracks from branch points in the well. Each gridblock or grid cell that the well intersects functions as a branch point for the sidetracks. The initial well trajectory is then surrounded by sidetracks to all adjacent grid blocks in each direction. An impression of the thus modelled virtual well 101 with pseudo sidetracks 102 is shown in FIG. 1.

A different approach would be to place dummy wells in gridblocks surrounding the well as described [D1]. In accordance with the invention the sidetrack approach is chosen over placing dummy vertical wells in each gridblock, because the effect of the sidetracks on the total well behaviour including lift and friction can be taken into account, whereas single vertical wells could only give information about a single gridblock. The sidetrack approach in the method according to the invention allows to take into account the impact of a trajectory shift on the total well behaviour, including in-well interaction of trajectory points on each other.

With the pseudo or virtual sidetracks 102 per well node a so-called "attractor point" (A) or "target direction" can be constructed in accordance with the invention based on the sidetracks from the branch point. The attractor points are used to move the trajectory in the direction of the attractor as illustrated in FIG. 2.

All the pseudo or virtual sidetracks 102 of the virtual well 101 shown in FIG. 1 are provided with a small perforation 103. The length of the perforation 103 is chosen such that it has a negligible influence on the overall flow in the reservoir. FIG. 3 shows the percentage of flow through the sidetrack perforation 103 versus the perforation length. The graph shows that with a perforation length of 10 centimeters, the production from all the sidetracks combined is about 0.75% of the total production of the well. Preferably, sidetrack perforation length of 20 millimeters is chosen, such that the overall flow in the reservoir is only very slightly influenced by the presence of the sidetracks.

From each branch point 105 of the virtual well shown in FIG. 1 there are sidetracks 102 to a maximum of six adjacent gridblocks (positive and negative x, y and z direction) not including the grid blocks through which the main wellbore runs, and not doubling counting "destiny points" over the entire trajectory. As illustrated in FIG. 1 mostly there are four sidetracks 102 from every branch point 105, with the exception of the end 106 of the virtual well 101, which has five sidetracks. We allowed every gridblock surrounding the virtual well 101 to have only one sidetrack, and sidetracks from other branch points to the same gridblock are removed. As a result there are situations in which a branch node 105 has only three sidetracks 102.

The sidetracks 102 are used to construct the attractor point A, and in order to do so, we need to evaluate the sidetracks with respect to their contribution to the NPV of the well. For this all the sidetracks are programmed with a reduction vector on the perforation (κ). This reduction vector acts like an inflow control valve (ICV) and can have a value between 0 (fully closed) and 1 (fully opened). With the adjoint method the gradient of the NPV with respect to the relative zonal productivity (KDH_multiplier) is calculated.

For each sidetrack 102 the gradient or sensitivity of J with respect to this κ is calculated using an adjoint model. The adjoint method as described in prior art references [D8] and [D10] has the advantage that it requires only one forward and one backward run to calculate all of the gradients.

In a well with real ICV's, the gradients can be used to determine the optimal ICV setting, however, in our heuristic approach, we make an alternative use of these gradients to find improved directions (attractor points) for the coordinates on the well trajectory. Our goal is to find the coordinates of the well trajectory that maximize J (eq. 1). Starting with an initial well trajectory through the points $t_{j,p}$. The subscript j stands for the iteration number and p for the coordinate points of the well (the well trajectory is defined by N(p) trajectory points). An improved trajectory is found moving the individual points into the direction of the attractor points A, where again j and p stand for respectively iteration and well coordinate point. To control the step size a weighting is used for the old trajectory point (α) and the attractor point (β).

$$t_{j+1,p} = \frac{\alpha t_{j,p} + \beta A_{j,p}}{\alpha + \beta} \tag{3}$$

Now that the principle has been explained of how attractor points are created and used, an explanation is provided how this is implemented.

From each (branch node) trajectory point $t_{j,p}$ there are three, four or five sidetracks (n=3, 4 or 5). This means that the attractor point has to be constructed using the gradients of n sidetracks.

During a forward and backward simulation, the gradients are calculated per timestep for each sidetrack. We use the sum over all timesteps (integral over time), per sidetrack as the gradient value $G_n$ per sidetrack. Furthermore the alonghole lengths $l_n$ of the sidetracks is taken into account. This is done because in the vertical (z) direction the next gridblock is only a few feet away, with sidetrack lengths as little as 2.1 m (7 ft), and in y and x the sidetrack lengths can be up to 105 m (350 ft). The relative importance of big-outstep sidetracks would otherwise easily be overrated.

Taking into account both the gradient value $G_n$ and the along hole (outstep) length $l_n$ an attractor point is calculated as the weighted average of all the sidetracks N from one trajectory coordinate point $t_{j,p}$. In eq. (6), $r_n^*$ is the vector starting from the branch point, towards the end of the sidetrack. (in case of a negative gradient this is opposite to that sidetrack direction). Eq. (7) shows that the attractor point is the weighted sum of all the vectors (n) of the sidetracks from that branch point.

$$G_n = \frac{\partial J}{\partial \kappa_n}, \tag{4}$$

$$\sigma_n = \left|\frac{G_n}{l_n}\right|, \tag{5}$$

$$r_n^* = r_n \cdot \mathrm{sign}(G_n), \tag{6}$$

$$A_{j,p} = t_{j,p} + \frac{\sum_{n=1}^{N} (\sigma_n r_n^*)}{\sum_{n=1}^{N} \sigma_n} \tag{7}$$

FIG. 4. shows this process, for clarification notional values have been chosen for the $\sigma_n$ (the gradient values and sidetrack lengths).

The first schematic shows position of the sidetrack and σ values. The sum of the absolute values of all $\sigma_n$ is 500. The second schematic shows the weighed pseudo sidetrack points. For example, sidetrack I with a σ value of −100 is moved with 1/5 (100 out of 500 total $\sigma_n$ value) into the opposite direction to point IB, because of a negative gradient value in this case. With the same method the pseudo sidetrack points IIB, IIIB and IVB are constructed. Finally, these points are added to construct the final attractor point.

Figure 5:
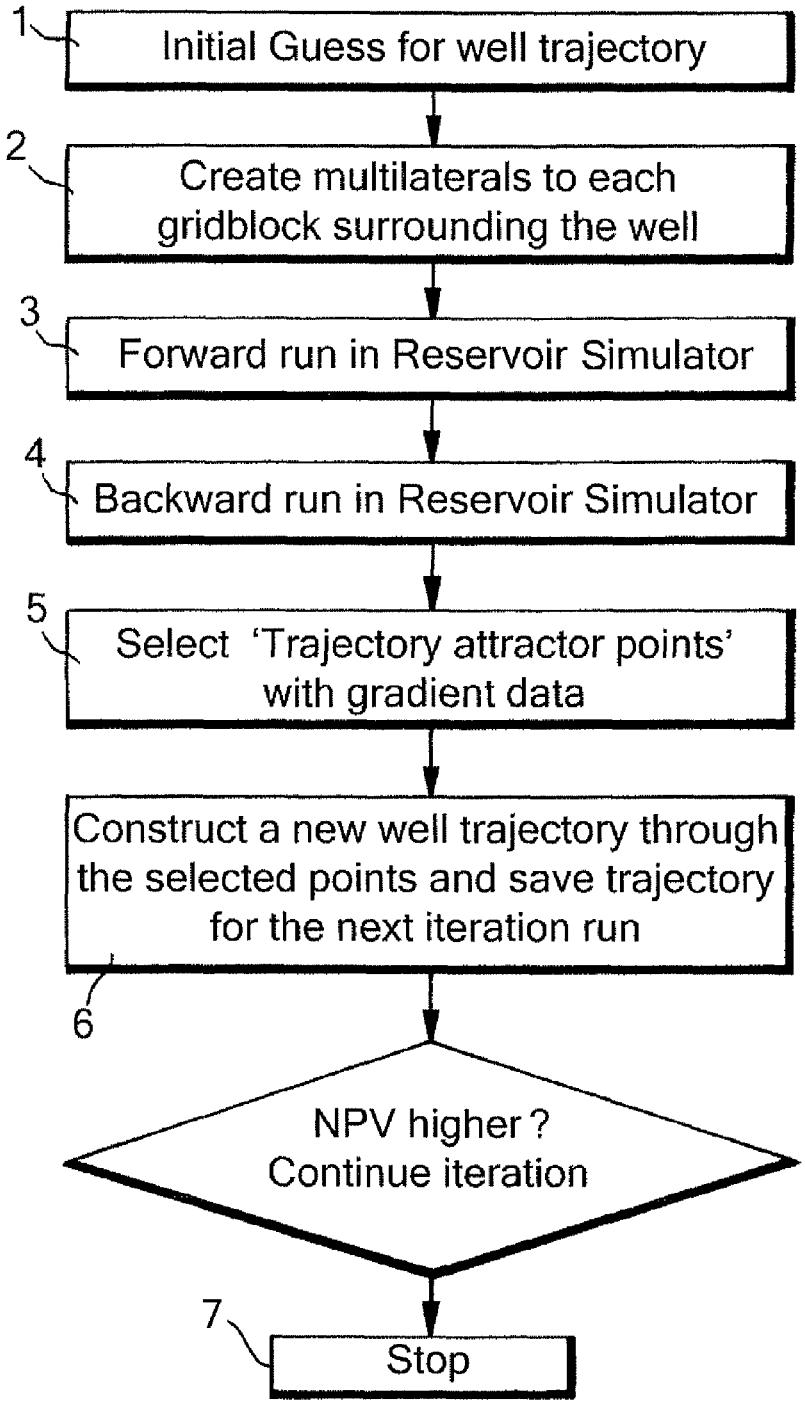
FIG. 5 shows an iteration scheme of the well trajectory optimization method according to the invention.

The seven steps of the well trajectory optimisation process according to the invention are briefly described in the flowscheme shown in FIG. 5. As the starting point in Step 1 an initial well trajectory $t_0$ is chosen, and then in Step 2 the sidetracks are constructed. In Steps 3 and 4 a forward run and a backward run for the calculation of the gradients with the adjoint method are performed. With the gradient information derived in Step 5 a new well trajectory is constructed in Step 6 after which the iteration loop continues until the NPV increase drops below a predetermined value or after a predetermined amount of iterations, whereupon the iteration process is stopped as illustrated in Step 7.

To be drillable, the selected trajectory identified in Step 6 should stay within certain prescribed limits for dogleg severity, or maximum allowable curvature. Our approach of creating attractor points does not guarantee this. Hence, an iterative process for smoothing the trajectory is used. The minimum curvature method is used to calculate the curvature for the well trajectory through the selected trajectory points ($t_{j,p}$). The algorithm was first described by Zaremba (1973)

using goniometric functions. Here, we present an alternative derivation using vector notation.

Figure 6:
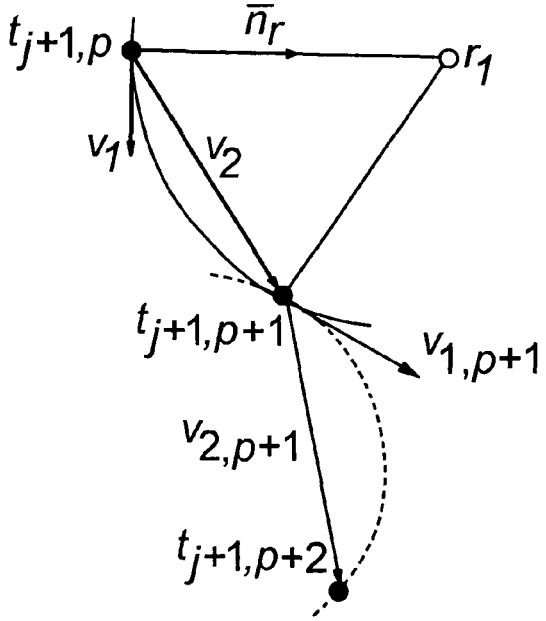
FIG. 6 depicts how of dogleg severity is calculated using the minimum curvature method.

Referring now to FIG. 6, for the calculation of the curvature between points tJ+lp and tJ+ip+la starting direction vector is needed for the first point, we take for this the direction between the first two points of the trajectory. It is not possible to construct a curve through two points if they are on an exact straight line, but an approximation (a line described by a curve with a very large radius) is 5 possible. Therefore we extract a small value E from the second point, we used the value 0.2 ft (~6 cm).

$$v_1=t_{j+1,1}-(t_{j+1,2}-\epsilon), \tag{8}$$

The minimum curvature method requires that there is a circular arc through the points $t_{j+1,p}$ and $t_{j+1,p+1}$. Therefore the directional vector at the first point needs to be orthogonal with to the vector ($n_r$) pointing in the direction of the centre of the circle, coplanar with the vector towards the second point.

If we now name $v_2$ the directional vector from the first to the second point, then the vector towards the centre of the circle through these points $n_r$ can be described as a linear combination of the two vectors.

$$v_2=t_{j,2}-t_{j,1}, \tag{9}$$

$$n_r=c_1v_1-c_2v_2, \tag{10}$$

Because $v_1$ is perpendicular to $n_r$ their inner (dot) product equals zero and $c_1$ can be written as:

$$c_1 = c_2\frac{v_1 \cdot v_2}{|v_1|^2}, \tag{11}$$

The distance from $t_{j+1,p}$ to the middle of the circle is the same as from $t_{j+1,p+1}$. We use that to calculate the midpoint $r_p=(r_x, r_y, r_z)$ from which the radius of the circle can now be calculated:

$$R_p=|r_p-t_{j,p}|, \tag{12}$$

This radius has to be above a minimum radius or the maximum dogleg severity will be exceeded. A maximum dogleg severity of 10 degrees per 100 ft (~30 m) is used, which is equivalent to a minimum curvature of 560 ft (~168 m).

Using the directional vector (tangent to the arc) in the second point, $v_{1,p+1}$ as starting vector for the calculation of the circular arc between second and third point, the radius can now be calculated here also and subsequently for all the points $t_{j+1,p}$.

With all points and radii known we can now check if the allowed maximum dogleg severity has been exceeded. The trajectory points that exceed this value are smoothed using the midpoint between the next and previous trajectory point. The replaced (smoothed) point, $t_{j+1,p}^{s}$ is constructed by drawing $t_{j+1,p}$ towards this midpoint with a factor $\tau$.

$$t_{j+1,p}^{s}=(1-\tau)\cdot(t_{j+1,p})+\tau\cdot(\tfrac{1}{2}t_{j+1,p-1}+\tfrac{1}{2}t_{j+1,p-1}), \tag{13}$$

With these points smoothed, the dogleg is calculated again. We iterate on this process until the dogleg severity is within the prescribed limits at each point on the trajectory.

Figure 7:
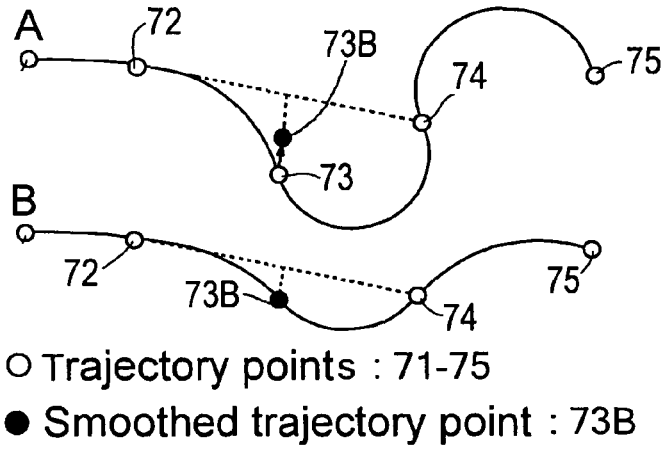
FIG. 7 depicts how the trajectory points are smoothened to reduce dogleg severity.

In FIG. 7 point 73 is drawn towards the middle of point 72 and 74, so that point 73 becomes smoothened point 73B. The figure shows how this influences the curvature between points 72, 73 and 73, 74 but also the curvature between points 74, 75. For the smoothing factor $\tau$ we used 0.2.

To test the model we consider a three-dimensional reservoir model of a plunging anticline dipping in both east and west directions with a fault running through the top of the anticline.

Figure 8:
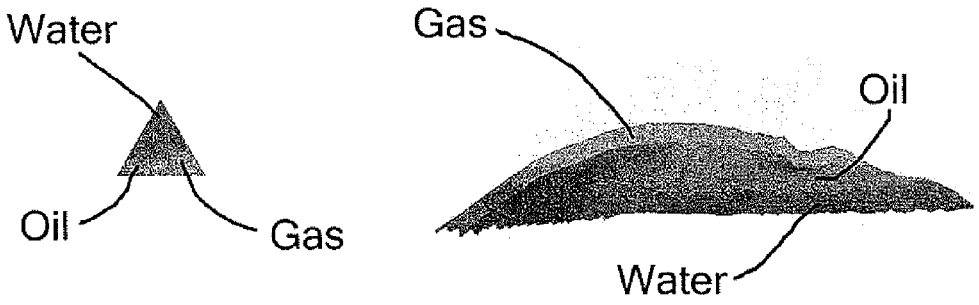
FIG. 8 shows a three-dimensional reservoir model with a height axis exaggerated by a factor 10.

FIG. 8. shows the model with the height axis exaggerated by a factor 20. The reservoir model consists of 10800 grid blocks, 80 in x direction and 15 in y and 9 in z direction. The dimensions of the reservoir are 6.35 km in x direction, 1.41 km in y direction and the height of the reservoir is 360 meters. This last value is the vertical distance between the lowest and the highest part of the reservoir. The average reservoir thickness is 80 meters, the average oil column being 90 m thick. Other than for the sealing fault there are no other faults in the reservoir.

The simulated reservoir is heterogeneous and has a permeability varying between 6.5 mD and 2700 mD.

Figure 9:
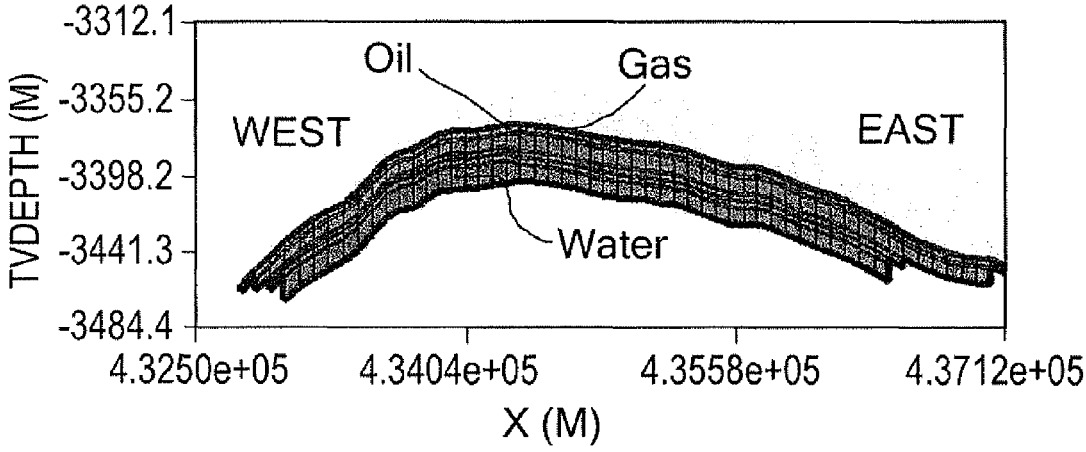
FIG. 9 shows the permeability distribution (of the vertical permeability) in an XZ cross-section within the reservoir model shown in FIG. 8.

FIG. 9 shows the permeability distribution (of the vertical permeability) within the simulated reservoir. Generally, the eastern part of the reservoir is more permeable then the western part.

The largest differences between the permeabilities occur in vertical direction, between the horizontal layers. The horizontal permeabilities in x and y direction are the same and in each gridblock the vertical permeability is one tenth of the horizontal permeability.

The values of the fluid properties are given in table 1, and the values of the rock properties are given in table 2.

TABLE 1

VALUE OF FLUID PROPERTIES

| Symbol | Value | Unit |
|---|---|---|
| $\rho_o$ | 723 | [kg/m$^3$] |
| $\rho_w$ | 997 | [kg/m$^3$] |
| $\rho_g$ | 162 | [kg/m$^3$] |
| $\mu_w$ | $0.25 \times 10^{-3}$ | [Pa s] |
| $\mu_o$ | $0.4 \times 10^{-3}$ | [Pa s] |
| $\mu_g$ | $0.015 \times 10^{-3}$ | [Pa s] |

TABLE 2

VALUE OF ROCK PROPERTIES

| Symbol | Min-Max | Average | Unit |
|---|---|---|---|
| $\Phi$ | 0.09-0.28 | 0.25 | [—] |
| $k_{h,x}$ | 65-2627 | 918 | [mD] |
| $k_{h,y}$ | 65-2627 | 918 | [mD] |
| $k_v$ | 6.5-262.7 | 91.8 | [mD] |

The relative permeabilities in the reservoir are described using a three-phase model. The diagram is shown in FIG. 10. The black lines indicate the residual oil, gas and water saturation. The grey lines are isoperms of the relative oil permeability.

In the section below, two cases are described in which the search method has been tested on the reservoir described previously. The reservoir is produced with one well; the well is initially located in the oil rim, marginally further away from the aquifer than from the gas cap. As the starting trajectory a straight line is chosen, but any other trajectory might also have been chosen. The well is produced with a rate constrain of 10.000 BBL/day, the simulator is run over a period of five years with time steps of 30 days. For the calculation of the NPV a discount factor of 0 is used.

Both scenarios have the same initial starting trajectory for the well. The cost function fluid parameters (fluid valuations) to calculate the objective function differ in each case. In the first case a favourable fluid valuation for the oil and negative for both the gas and water are chosen. In the second case a positive value for the gas is chosen.

Example 1

In Example 1 both the gas and water are given a negative value (table 3).

TABLE 3

| ECONOMIC CONSTANTS FOR COMPUTING NPV | | |
|---|---|---|
| Symbol | Value | Unit |
| $r_o$ | 20.00 | [$/BBL] |
| $R_g$ | −0.20 | [$/m$^3$] |
| $R_w$ | −4.00 | [$/BBL] |

It is anticipated that the optimal trajectory will lie in the oil rim, at an optimal location where both the water and gas production are limited.

FIG. 11 shows the NPV of the well against the number of iterations for Example 1. It can be seen that after 14 iterations an optimum is found. From that point on, the NPV converges within a localized band. The total increase between the lowest and highest value is 20%.

In FIG. 12 the well trajectories during the iteration process are displayed. The initial trajectory is a straight line from the top left to the bottom right. The first iterations (grey lines) show that the trajectory gradually moves to its optimal trajectory, the black dotted line, but after that is stays in approximately the same position and has much smaller displacements. The optimum that is reached in the 17$^{th}$ iteration is shown as a red dotted line.

The direction in which the well moves is towards the aquifer. This is caused mainly by the high penalty on gas, and relative low penalty on water production. The well therefore seeks a trajectory away from the gas cap to a lower position in the oil rim in the direction of the water.

Figure 13:
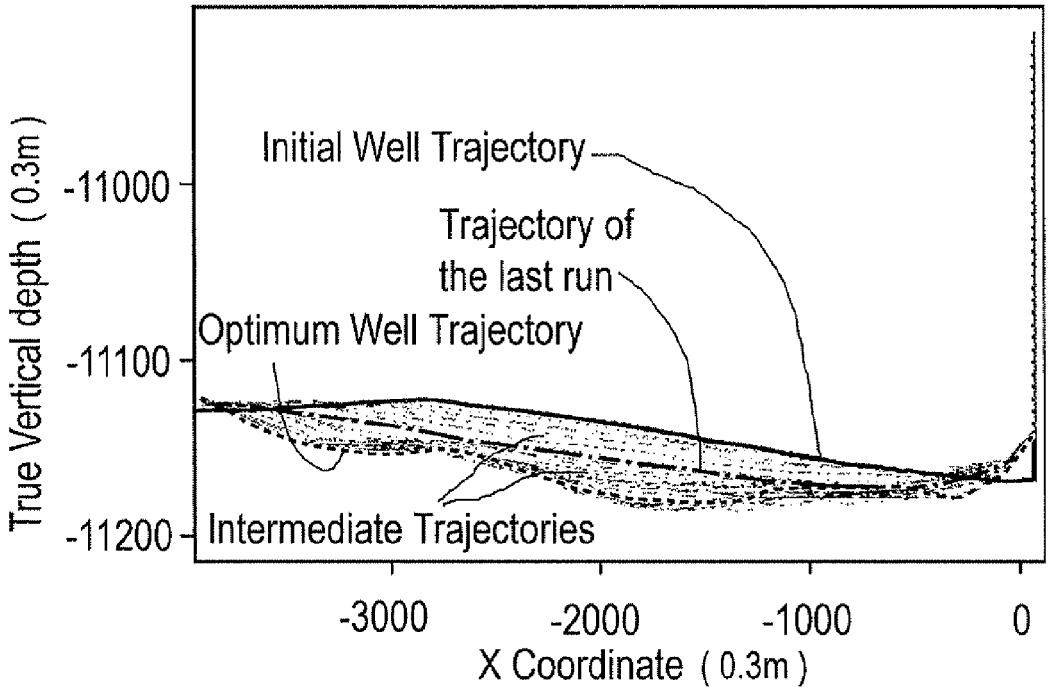
FIG. 13 shows a side view of the moving well trajectory.

In FIG. 13, showing the XZ plot of the moving well trajectories, the same pattern can be seen. The first trajectories show a clear displacement towards a preferred direction. Then the well stays in more or less the same position for several iterations.

Figure 14:
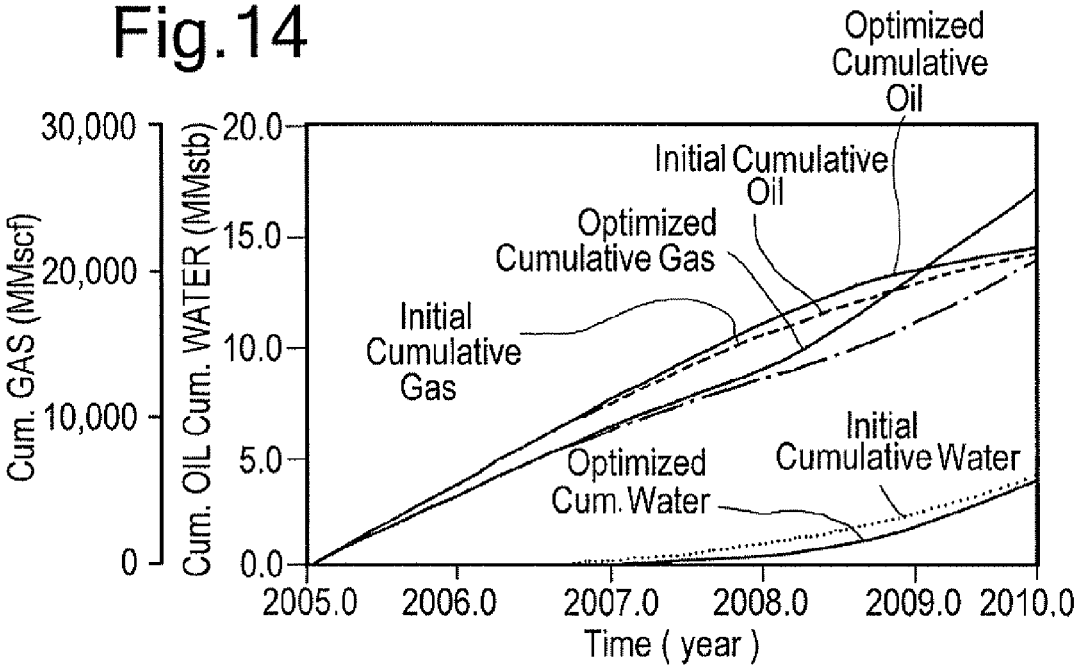
FIG. 14 shows the cumulative production from the well, for the first iteration (the lowest NPV) and the $17^{th}$ iteration (the highest NPV)

FIG. 14 shows the cumulative production from the well, for the first iteration (the lowest NPV) and the 17$^{th}$ iteration (the highest NPV).

The cumulative oil production and water production are almost the same and the gain in NPV is a result of the much lower gas production.

Example 2

For Example 2 a different fluid value is chosen as shown below in table 3. This value is chosen because it is expected to generate a clear shift in optimised well trajectories towards the gas cap.

TABLE 3

| ECONOMIC CONSTANTS FOR COMPUTING NPV | | |
|---|---|---|
| Symbol | Value | Unit |
| $r_o$ | 40.00 | [$/BBL] |
| $R_g$ | 0.80 | [$/m$^3$] |
| $R_w$ | −0.40 | [$/BBL] |

Figure 15:
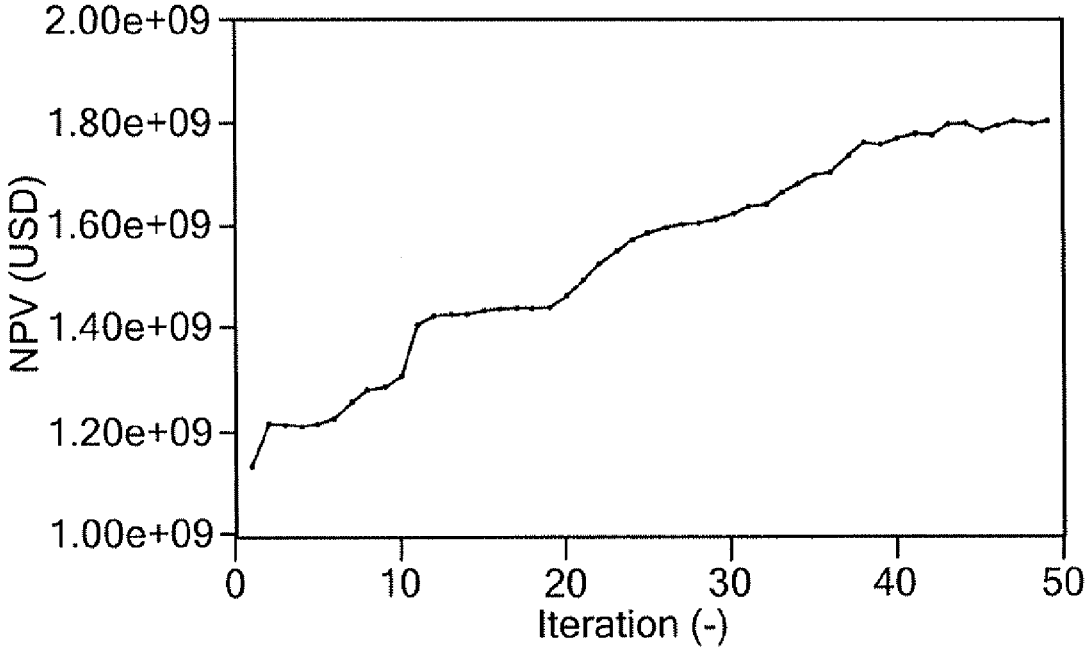
FIG. 15 shows NPV versus iteration and that the NPV plot has a very large increase, (45%) after 50 iterations.

The NPV plot made in accordance with the invention is shown in FIG. 15 for Example 2 and indicates a large increase, (45%) after 20 iterations and a quite different pattern than in the Example 1. Except for 4$^{th}$ and 19$^{th}$ iteration, every run has a higher NPV than its predecessor.

Figure 16:
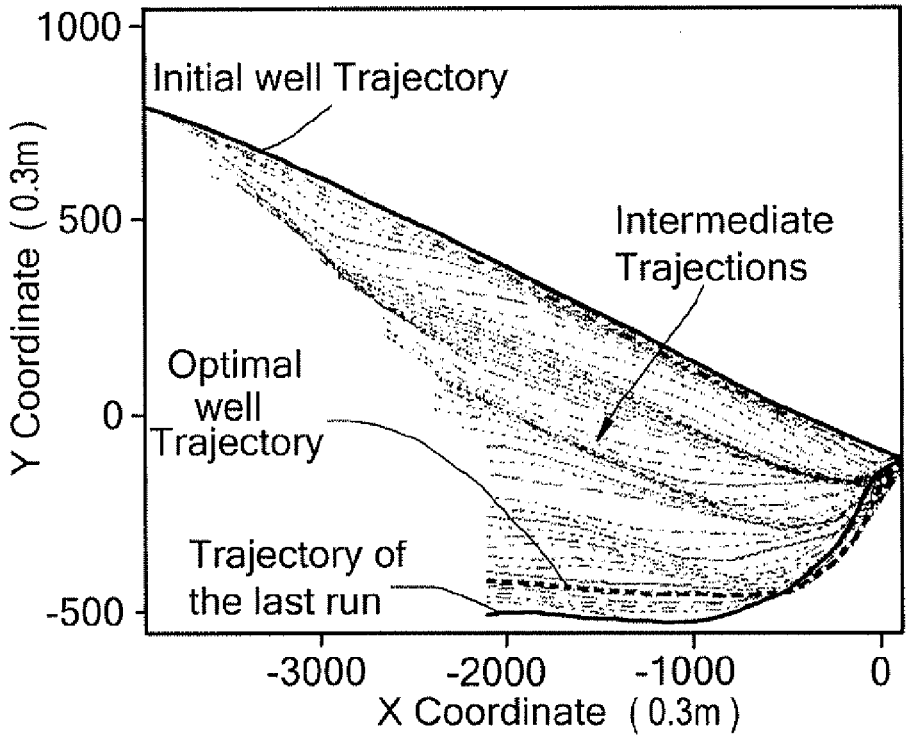
FIG. 16 is a top view of the moving well trajectory
Figure 17:
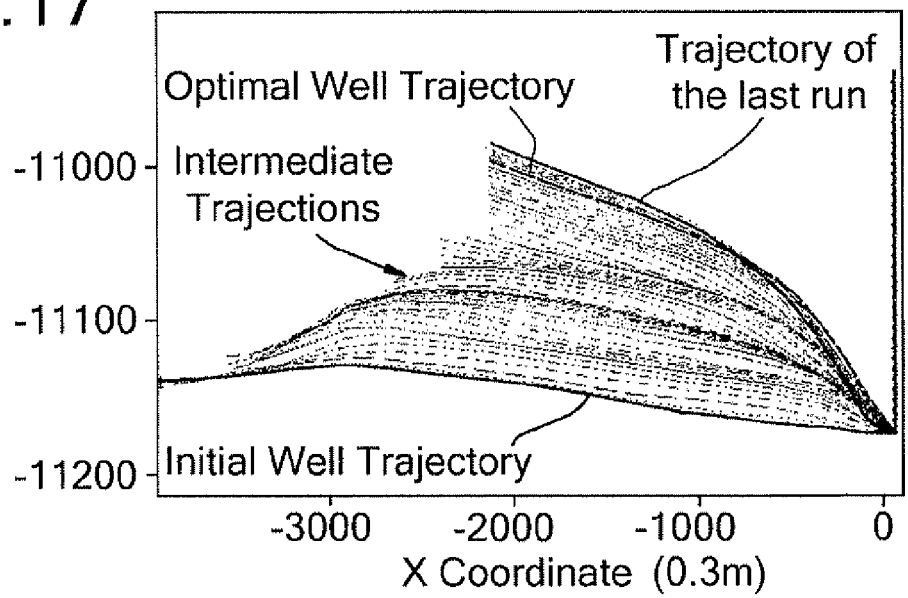
FIG. 17 is an XZ plot of the moving well trajectory shown in FIG. 16, which plot has a clear shift towards the gas cap.

The trajectory plots shown in FIGS. 16 and 17 are generated by the method according to the invention for Example 2 and have a clear shift towards the gas cap. In the top view, the well is moving away from the aquifer into the gas cap, which can also be seen in the cross-section.

Figure 18:
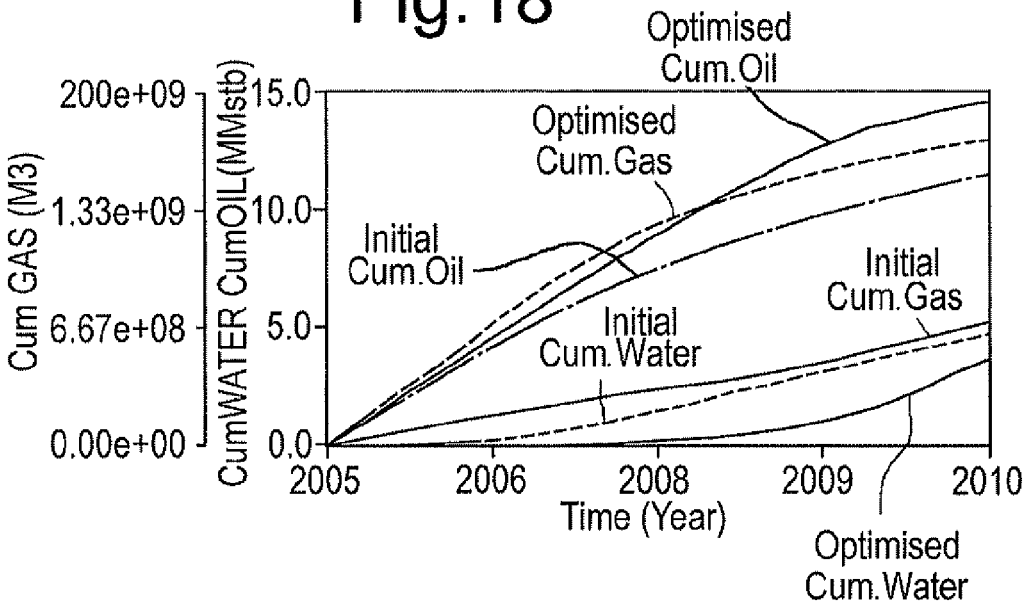
FIG. 18 shows the cumulative production of the first virtual well compared with the optimal virtual well as defined in accordance with the method according to the invention.

In FIG. 18, showing the cumulative production for Example 2, it is now clear that the well trajectory searches for a position with a higher gas production, because of the positive value of the gas.

FIG. 15-18 indicate that the scope for optimisation is much larger in Example 2 than in Example 1. The thin oil rim was bounded on top by the gas and below by the water, but the bulk of the gas cap is much further up in the structure. In Example 2 we chose a weighting between the old and new trajectory of 3:1, limiting the step size. For the first few steps in particular, a larger step size could have been chosen (minimizing the amount of needed runs before the optimum is reached).

In the trajectory figures it is clear to see how the well shifts towards an optimum and with every step the NPV is increased.

The method according to the invention provides a significant step towards a fully automated, gradient based, iterative search algorithm for well trajectory optimisation. It is explained with respect to Examples 1 and 2 with reference to a small but realistic full field model and the results look very promising for the methodology.

There are, however, a number of aspects that should be taken into account if the method according to the invention is applied.

In the Examples the trajectory optimisation part with the construction of the sidetracks was only applied in the horizontal part of the well, the reservoir entry point and the first 5 penetrated grid blocks or grid cells were fixed. A result of this is that the trajectory movement is mostly limited to z and y directions. The optimum found is most probably a very local one. Since the test field stretched in x direction this was not very important for the testing of the algorithm.

A second point of attention is the last trajectory point. The two Examples show that the endpoint needs a different approach. Because the last sidetrack is mostly in x direction and the gradient value is usually quite high compared to the other four sidetracks, the last trajectory point tends to stay in almost the same position during the iteration runs. It would be preferred that the last sidetrack gives information on the total trajectory length, allowing it to grow or shrink depending on the gradient value. This is a practical limitation within the current implementation.

A third point of attention is on the model used. The reservoir model has a rather coarse grid. As a result of this the algorithm steps quite quickly through the reservoir (Example 2) or requires many iterations to converge to an optimum (Example 1). The oil rim is very thin compared with the gridblock size, it is only a few gridblocks thick in both z and y direction. Because of this a small vertical step up or down means an immediate reduction in production. It would be preferred to also apply test the methodology used in the Examples on a more refined reservoir model. Because of the actual implementation of the syntax, this was not done for the Examples.

In the light of the experiences of the foregoing Examples the following conclusions may be drawn:

A) The adjoint-based well trajectory optimisation algorithm according to the invention is able to find "attractor points" or "target directions" efficiently for new improved well trajectories.

B) The results are promising for the methodology, but the implementation in accordance with the Examples has some limitations.

C) Like in other gradient-based methods, the well trajectory optimisation algorithm according to the invention cannot automatically distinguish local optima from global optima.

D) A multi-zone well would require an extra inner-loop iteration using adjoints to optimise IVC settings before each of the gradients is taken and a new set of attractor or target points is defined.

In the light of these conclusions, it is preferred that the well trajectory optimisation algorithm according to the invention is re-run over several geological scenarios in order to come to a robust optimal well and/or well cluster trajectory such that the reservoir depletion strategy is optimised by using an optimized cluster of hydrocarbon production and/or fluid injection wells traversing the crude oil and/or natural gas containing reservoir.

The invention claimed is:

1. A method for producing hydrocarbon fluid through a well or well cluster of which the trajectory is at least partly defined by a well trajectory optimization algorithm that is coupled to a finite difference reservoir simulation program that represents a hydrocarbon fluid containing reservoir as a set of grid cells with a specified permeability and fluid content, comprises:

providing a virtual well with a series of virtual well branches that extend to inflow points of the virtual well; and subsequently iteratively moving the inflow points of the virtual well through the reservoir;

wherein the well trajectory optimization algorithm iteratively moves the inflow points of the virtual well such that a modified well trajectory is defined with a higher Net Present Value (NPV) than its predecessor in order to optimize a reservoir depletion strategy by the well; and further including the steps of:

a) defining an initial well trajectory of a virtual well with a series of fluid inflow points in the reservoir;

b) providing the virtual well with a series of virtual well branches that extend to the inflow points of the virtual well;

c) using the reservoir simulation program to assign relative impact of all principal virtual well branches on the reservoir depletion strategy, which strategy identifies a life cycle value of the virtual well;

d) identifying, based on the assigned relative impact, a series of target points to which a series of inflow points of the virtual well should be moved in order to obtain an optimized reservoir depletion strategy that provides a higher life cycle value of the virtual well;

e) modifying the defined initial virtual well trajectory into an optimized and drillable well trajectory of an optimized virtual well of which a series of inflow points are migrated towards a series of target points;

f) repeating steps b), c), d) and e) a number of times, iteratively further optimizing the trajectory of the virtual well until a final virtual well trajectory is defined by the well trajectory optimization algorithm;

g) drilling and completing a well which has the final virtual well trajectory as a target; and h) producing hydrocarbon fluid through the well from the hydrocarbon fluid containing reservoir.

2. The method of claim 1, wherein during step f) steps b)-e) are repeated until a difference calculated by the reservoir simulation program between the life cycle values of an optimized virtual well and a further optimized virtual well is below a predetermined value, or until a predetermined number of iterations is reached.

3. The method of claim 1, wherein the method further comprises:

i) in step e) modifying the initially defined well trajectory into an optimized branched virtual well trajectory, which comprises at least one virtual branch oriented towards at least one target point resulting in a life cycle value which is higher than the life cycle value of the non-branched virtual well;

j) repeating steps b), c), d), e) and i) a number of times, iteratively further optimizing the trajectory of the branched virtual well until a final branched virtual well trajectory is defined by the well trajectory optimization algorithm;

k) drilling and completing a branched well which has the final branched well trajectory as a target; and l) producing hydrocarbon fluid via the branched well from the hydrocarbon fluid containing reservoir.

4. The method of claim 1, wherein the method further comprises:

m) in step e) modifying the initially defined well trajectory into an optimized trajectory of a cluster of at least two optimized virtual wells, which each comprise inflow points at at least two target points of the initially defined well trajectory having a life cycle value which is higher than the life cycle value of the initially defined well trajectory;

n) repeating steps b), c), d) e) and m) a number of times, iteratively further optimizing the well trajectories of the cluster of at least two virtual wells until a final virtual well cluster with a final virtual well trajectory for each of the wells is defined by the well trajectory optimization algorithm;

o) drilling and completing a cluster of wells which has the final well cluster and the associated final well trajectories as a target; and p) producing hydrocarbon fluid via the cluster of wells from the hydrocarbon fluid containing reservoir.

5. The method of claim 4, wherein the method further comprises:

q) modifying an initially defined pattern of virtual hydrocarbon fluid production, fluid injection and/or observation wells traversing a hydrocarbon fluid containing reservoir into an optimized pattern of virtual hydrocarbon fluid production, fluid injection and/or observation wells;

r) repeating step q) a number of times, iteratively further adjusting the virtual well pattern until a final virtual well pattern is obtained which provides an optimized reservoir depletion strategy with respect to an optimized well pattern, well architecture and well trajectory as defined by the well trajectory optimization algorithm;

s) drilling a well pattern which has the optimized well pattern, architecture and trajectory of the final virtual well pattern as a target; and t) producing hydrocarbon fluid from the reservoir through the thus optimized well pattern.

6. The method according to claim 1 wherein the well is an oil or gas production well and the optimised reservoir depletion strategy and/or the "life cycle value" (J) are defined as total oil revenue plus total gas revenue or minus total gas handling costs and minus water production or injection costs over a time interval [0,T], where T is time, in combination with a discount factor d, and wherein $r_o$ denotes oil revenue per unit volume, $r_w$ denotes water disposal cost per unit volume, and $r_g$ denotes gas revenue or disposal cost per unit volume, such that:

$$J(traj) = \int_0^T V \cdot \frac{1}{(1 + d(t))^t} dt \quad (1)$$

$$V = \underbrace{r_o \cdot q_o(t)}_{oil} + \underbrace{r_w \cdot q_w(t)}_{water} + \underbrace{r_g \cdot q_g(t)}_{gas} \quad (2)$$

and wherein $q_o$, $q_w$ and $q_g$ are production or injection rates for oil, water, and gas respectively over the entire time interval and the vector traj is a composite vector, representing a complete well trajectory or complete set of well trajectories of an entire well pattern.

7. The method of claim 1 wherein a reservoir depletion strategy of a well or well cluster is optimized such that a life cycle value of the well or well cluster is optimized and/or a Net Present Value (NPV) of crude oil and/or natural gas produced throughout the life cycle of the reservoir is optimized, and/or a maximum percentage of crude oil and/or gas from the reservoir is produced throughout the life cycle of the reservoir.

* * * * *